US005126221A

United States Patent [19]

Chiba et al.

[11] Patent Number: 5,126,221

[45] Date of Patent: Jun. 30, 1992

[54] COLOR DEVELOPERS FOR USE IN MULTI-COLOR ELECTROPHOTOGRAPHY AND IMAGE FORMATION METHOD USING THE SAME

[75] Inventors: Shunichi Chiba, Numazu; Satoru Inoue, Mishima; Akio Matsui, Numazu; Yoshihisa Okamoto, Fuji; Chiharu Mochizuki, Numazu, all of Japan

[73] Assignee: Ricoh Company, Ltd., Tokyo, Japan

[21] Appl. No.: 529,189

[22] Filed: May 24, 1990

[30] Foreign Application Priority Data

May 30, 1989 [JP] Japan ..... 1-137130

[51] Int. Cl.[5] ..... G03G 9/09

[52] U.S. Cl. ..... 430/45; 430/106

[58] Field of Search ..... 430/109, 106, 45

[56] References Cited

U.S. PATENT DOCUMENTS

| | | | |
|---|---|---|---|
| 4,533,614 | 8/1985 | Fukumoto et al. | 430/109 |
| 4,795,689 | 1/1989 | Matsubara et al. | 430/109 |
| 4,908,290 | 3/1990 | Watanabe et al. | 430/109 |

*Primary Examiner*—John Goodrow

*Attorney, Agent, or Firm*—Cooper & Dunham

[57] ABSTRACT

A set of color developers for use in multi-color electrophotography comprises (a) a yellow developer, (b) a magenta developer, (c) a cyan developer, and (d) a black developer, in which the viscoelasticity ($\tan\delta^1$) of each of the yellow developer, the magenta developer and the cyan developer is smaller than the viscoelasticity ($\tan\delta^2$) of the black developer at a storage modulus ($G'(\omega)$) of $10^5$ dyn/cm$^2$. This set of color developers is particularly suitable for use with a digital multi-color electrophotography.

17 Claims, No Drawings

COLOR DEVELOPERS FOR USE IN MULTI-COLOR ELECTROPHOTOGRAPHY AND IMAGE FORMATION METHOD USING THE SAME

BACKGROUND OF THE INVENTION

1. Field of the Invention

This invention relates to a set of color developers for use in multi-color electrophotography, particularly suitable for use in digital multi-color electrophotography, and a multi-color electrophotographic image formation method using the same, capable of producing high quality glossy images.

2. Discussion of Background

Although various electrophotographic image formation methods are disclosed, for example, in U.S. Pat. No. 227,691, and Japanese Patent Publications 42-23910 and 43-24748, the most common method is such that a latent electrostatic image is first formed on the surface of a photoconductive support by using a photoconductive material and then developed with a developer (toner) to obtain a visible image, or a toner image is transferred to a sheet of paper or the like and then fixed thereon by application of heat or pressure, or by the use of a vaporized solvent to obtain visible images.

A multi-color electrophotographic image formation method of an analogue type is disclosed, for example, in U.S. Pat. No. 2,962,374. In this method, the colors of an original image are separated and converted into electric signals corresponding to at least three colors of yellow, magenta and cyan, and the surface of a photoconductor is electrically charged in accordance with each of the color signals to form a latent electrostatic image corresponding to each of the separated colors, and each of the latent images is then successively developed with a corresponding color developer of yellow, magenta or cyan to obtain multi-color images.

In addition, various proposals are now being made on a multi-color electrophotographic image formation method of a digital type. In this method, an original image is subjected to color separation to obtain color signals, which are then subjected to an A/D conversion to obtain digital color signals. By conducting a predetermined computation, recording signals are obtained from the digital color signals, and latent electrostatic images are formed on the surface of a photoconductor in accordance with the digital signals. The latent images are then developed with color developers to obtain visible multi-color images.

As described above, in the digital multi-color electrophotographic image formation method, the optical information is subjected to computation, so that the masking treatment and the UCR (undercolor removal) treatment can be carried out, which cannot be successfully carried out in the conventional multi-color electrophotographic image formation method of an analogue type.

In the case where the UCR treatment is conducted, a latent image corresponding to black color can be developed with a black developer to obtain a black image, instead of successively overlapping yellow, magenta and cyan toner images. A gray balance of the obtained images can thus be improved; in other words, excellent half-tone images are obtainable. In addition, the thickness of the toner layer of the black area obtained by using a black developer is thinner than that of the black area obtained by super-imposing yellow, magenta and cyan images. The digital method is therefore economically advantageous, and can provide images without the problem of the curling of a transfer sheet.

A black developer and color developers of yellow, magenta and cyan are required to have high chargeability, low environmental dependency and high fixing ability. It is also required that they be not deteriorated even when they are repeatedly used for a long period of time. In addition to the above, the color developers are required to have good characteristics in terms of the spectral reflectance, high transparency, and capabilities of exhibiting bright mixed-color and to producing images having a proper degree of glossiness.

In order to fulfill the above requirements, a resin having relatively low softening point and high transparency is used as a binder resin in the color developers for use in the conventional multi-color electrophotography of an analogue type.

In the case where such a binder resin is incorporated into a black developer for use in the digital multi-color electrophotography in which the UCR treatment is conducted, the viscoelasticity of the black toner is almost equal to that of each of the color developers of yellow, magenta and cyan.

It is well known that the glossiness of the obtained images varies depending upon the viscoelasticity of the developer and the thickness of a toner layer.

When multi-color images are formed by the digital method using the black and color developers of magenta, yellow and cyan, the toner layer of a black area is thinner than that of a secondary color (red, green, blue) area. As a result, the glossiness of the black area is lower than that of the other areas. Uneven glossiness brings about low image quality. In particular, the glossiness of a black area has psychological importance. Therefore, it is necessary to enhance the glossiness of the black images to at least as high as that of the images in other colors.

SUMMARY OF THE INVENTION

Accordingly, an object of the present invention is to provide a set of color developers of black, yellow, magenta and cyan for use in multi-color electrophotography, free from the aforementioned drawbacks in the prior art.

Another object of the present invention is to provide a multi-color electrophotographic image formation method which can form multi-color images on a transfer sheet with even glossiness without curling the transfer sheet.

The above objects of the invention can be attained by a set of color developers for use in multi-color electrophotography, which comprises (a) a yellow developer, (b) a magenta developer, (c) a cyan developer, and (d) a black developer, in which the viscoelasticity ($\tan\delta^1$) of each of the yellow developer, the magenta developer and the cyan developer is smaller than the viscoelasticity ($\tan\delta^2$) of the black developer at a storage modulus ($G'(\omega)$) of $10^5$ dyn/cm$^2$; and by a multi-color electrophotographic image formation method of forming multi-color images on a transfer sheet, comprising the steps of (i) separating the colors of an original image into yellow, magenta, cyan, and black, (ii) converting the separated colors into the respective color signals, (iii) forming a latent electrostatic image corresponding to each of the separated colors on an electrophotographic photoconductor in accordance with the respective color signals, (iv) developing the latent electrostatic images to yellow, magenta, cyan and black images by each of the above-described set of color developers, and (v) transferring the developed yellow, magenta, cyan and black images to a transfer sheet.

DETAILED DESCRIPTION OF THE PREFERRED EMBODIMENTS

A set of color developers of the present invention is characterized in that the viscoelasticity in terms of the loss tangent ($\tan\delta^1$) of each of a yellow developer, a magenta developer and a cyan developer is smaller than the viscoelasticity in terms of the loss tangent ($\tan\delta^2$) of a black developer at a storage modulus (G'(107)) of $10^5$ dyn/cm$^2$.

In particular, when the viscoelasticity ($\tan\delta^1$) and the viscoelasticity ($\tan\delta^2$) satisfy the relationship of $2.8 < \tan\delta^1 < \tan\delta^2 < 3.8$ at a storage modulus ($G'(\omega)$) of $10^5$ dyn/cm$^2$, excellent results can be obtained.

Namely, when the values of $\tan\delta^1$ and $\tan\delta^2$ satisfy the above relationship, the black developer can impart higher glossiness to the images than the other color developers do. For this reason, multi-color images with even glossiness can be obtained, and the quality of the images can thus be greatly improved.

Toner particles provided on an image transfer sheet are fixed thereon by application of heat and/or pressure during the image fixing process. During this process, if the toner surface is made microscopically smooth, highly glossy images can be obtained. On the other hand, if the toner surface cannot be made smooth, glossy images cannot be obtained.

The toner images formed on the transfer sheet are softened or fused when they are heated or pressed by a heat-application roller or a pressure-application roller, whereby the toner images can be fixed on the sheet. During this process, toner images formed by a developer which is relatively viscous can be sufficiently deformed when they are passed through between a pair of image-fixing rollers. Therefore, the surface of the toner images can acquire smoothness, and the obtained images exhibit high glossiness. On the other hand, when toner images formed by a developer which is relatively elastic, the toner images deformed by application of pressure is partly restored due to the elasticity. The obtained images thus have a rough surface, and cannot exhibit high glossiness.

As mentioned previously, when the relationship between the viscoelasticity ($\tan\delta^1$) of each of a yellow developer, a magenta developer and a cyan developer, and the viscoelasticity ($\tan\delta^2$) of a black developer is properly controlled, the black developer can impart glossiness to images with a higher degree than the other color developers.

In the present invention, it is preferable that the values of $\tan\delta^1$ and $\tan\delta^2$ be greater than 2.8 but smaller than 3.8 in order to obtain high glossiness when fixed by silicone rubber-coated fixing rollers at low temperatures, and to avoid a hot off-set phenomenon even at low temperatures.

In the present invention, the viscoelasticity of the developer is represented by its loss tangent ($\tan\delta$) which can be determined by the following method:

First the temperature dependency of each of yellow, magenta, cyan and black developers was determined by a RHEOMETRICS DYNAMIC SPECTROMETER RDS-7700 type (Trademark, made by RHEOMETRICS. INC. in U.S.A.). During the measurement, a constant angular frequency ($\omega$) of 100 rad/sec was applied, the distortion factor was automatically changed, and the temperature of a sample was gradually elevated. From the results obtained, the loss tangent of each of the developers at a storage modulus, $G'(\omega)$, of $10^5$ dyn/cm$^2$ was calculated.

Each of the developers of yellow, magenta, cyan and black according to the present invention comprises a binder resin and a coloring agent, and, if necessary, a charge controlling agent. The developers of the present invention can be prepared by any of the known methods.

It is preferable to use a polyester resin as the binder resin of the developers of the present invention because it has high transparency and hardly sticks to a vinyl chloride sheet even when it is fused. In addition, images formed by the developers containing polyester resin can be firmly fixed on a transfer sheet even when fixed at low temperatures. In particular, a polyester resin synthesized from a bisphenol-type diol and a polyvalent carboxylic acid is most preferred.

Examples of the bisphenol-type diol include polyoxypropylene (2,2)-2,2-bis[4-hydroxyphenyl)propane, polyoxyethylene (2)-2,2-bis(4-hydroxyphenyl)propane, polyoxystyrene (6)-2,2-bis(4-hydroxyphenyl)propane, polyoxybutylene (2)-2,2-bis(4-hydroxyphenyl)propane, polyoxypropylene (3)-bis(4-hydroxyphenyl)thioether, polyoxypropylene (2)-2,2-bis(4-cyclohexanol)propane, polyoxyethylene 2)-2,6-dichloro-4-hydroxyphenylphenol, polyoxyethylene (2,5)-p,p-bisphenol, polyoxybutylene (4)-bis[4-hydroxyphenyl)ketone, oxyethylene-2,2-bis(4-hydroxyphenyl)propane, and oxypropylene-2,2-bis(4-hydroxyphenyl)propane.

Furthermore, ethylene glycol, propylene glycol, 1,4-butane diol, 1,5-pentane diol, 1,6-hexane diol, glycerin, trimethylolethane, trimethylolpropane and aliphatic polyols such as penthaerythritol may be used as an alcoholic component, if necessary.

Examples of the polyvalent carboxylic acid include divalent aromatic carboxylic acids such as phthalic acid, isophthalic acid, phthalic anhydride, terephthalic acid and its derivatives such as terephthalic acid esters; trivalent aromatic polycarboxylic acids such as 1,2,4-benzene tricarboxylic acid, 1,2,5-benzene tricarboxylic acid, 1,2,4-naphthalene tricarboxylic acid and 2,5,7-naphthalene tricarboxylic acid, and anhydrides and esters of the trivalent aromatic polycarboxylic acids; tetravalent aromatic polycarboxylic acids such as 1,2,4,5-benzene tetracarboxylic acid, and anhydrides and esters thereof; divalent aliphatic carboxylic acids such as maleic acid, fumaric acid, succinic acid, adipic acid, sebatic acid and malonic acid; divalent organic acid monomers prepared by substituting the above divalent aliphatic carboxylic acids with a saturated or unsaturated hydrocarbon group having 8 to 22 carbon atoms, and anhydrides thereof; a dimer of a lower alkylester and linoleic acid; and monomers of other divalent organic acids.

In order to improve the properties of the developers, such as the fluidity, non-filming property, crushability, chargeability and fixing ability, any known resins for use in a developer may be incorporated into the developers of the present invention, if necessary.

Examples of such resins include homopolymers of styrene or its substitution compound such as polystyrene, poly-p-styrene and polyvinyl toluene, styrene-based copolymers such as a styrene—p-chlorostyrene copolymer, a styrene—propylene copolymer, a styrene—vinyl toluene copolymer, a styrene—methylacrylate copolymer, a styrene—ethylacrylate copolymer, a styrene—butylacrylate copolymer, a styrene—methylmethacrylate copolymer, a styrene—ethylmethacrylate copolymer, a styrene—butylmethacrylate copolymer, a styrene—α-chloromethylmethacrylate, a styrene—acrylonitrile copolymer a styrene—vinylmethyl ether copolymer, a styrene—vinylmethyl ketone copolymer, a styrene—butadiene copolymer, a styrene—isoprene copolymer, a styrene—maleic acid copolymer and a styrene—maleic acid ester copolymer, polymethylmethacrylate, polybutylmethacrylate, polyvinyl chloride, polyvinyl acetate, polyethylene, polypropylene, polyurethane, polyamide, an epoxy resin, polyvinyl butyral, a polyacrylic acid resin, rosin, modified rosin, a terpene resin, a phenol resin, an aliphatic resin, an aliphatic hydrocarbon resin, an aromatic petroleum resin, chlorinated paraffin and a paraffin wax. These resins can be used either singly or in combination.

The incorporation amount of the above resin is, in general, 30 wt. % or less of the weight of the binder resin. At any rate, the resin should not impede the effects of the present invention.

Any known coloring agents for a developer can be used as the coloring agent of the developers of the present invention.

Examples of black coloring agents include carbon black, aniline black, furnace black and lamp black.

Examples of cyan coloring agents include Phthalocyanine Blue, Methylene Blue, Victoria Blue, Methyl Violet, Aniline Blue and Untramarine Blue.

Examples of magenta coloring agents include Rhodamine 6G Lake, Watching Red, Rose Bengale, Rhodamine B and Alizarine Lake.

Examples of yellow coloring agents include Chrome Yellow, Benzidine Yellow, Hansa Yellow, Naphthol Yellow, Molybdenum Orange, Quinoline Yellow and Tartrazine.

Any known charge controlling agents can be used in the developers of the present invention, and among them colorless or white ones are preferably used because they do not lower the transparency of the developers.

Examples of the charge controlling agent include organic metal compounds such as organic salts or complexes containing a polyvalent metal which is selected from Al, Ba, Ca, Cd, Cr, Cu, Fe, Hg, Mg, Mn, Ni, Pb, Sn, Sr and Zn. Of these, metal salts of salicylic acid and metal salts of salicylic acid derivatives are preferred.

Auxiliary compounds, for example, a fluidity-imparting agent such as colloidal silica, an abrasive such as silicon carbide, or a metal oxidized compound, for instance, titanium oxide or aluminum oxide, and a lubricant such as a metal salt of fatty acids.

The developers of the present invention can be used as either mono-component type developers or two-component type developers.

In the case where the developers are used as two-component type developers, iron powder, nickel powder, ferrite powder, magnetite powder or glass beads having a diameter of 20 to 200 μm can be used as a carrier. Furthermore, the above metal powders and glass beads coated with a fluorine resin, a silicone resin, a styrene resin or an acrylic resin can also be used.

When a set of the above-described developers of yellow, magenta, cyan and black is used in a multi-color electrophotographic image formation method, glossy images with high quality can be obtained.

More specifically, the color of an original image is separated into yellow, magenta, cyan and black, and the separated colors are converted into the respective color signals. A latent electrostatic image corresponding to each of the separated colors if formed on an electrophotographic photoconductor in accordance with the respective color signals, and then developed with each of the above-described color developer of the present invention. The developed yellow, magenta, cyan and black toner images are transferred to a transfer sheet.

In a series of the above steps, it is also acceptable to convert the color signals obtained by the color separation from analogue to digital. In the case where the A/D conversion is performed, the above-described steps are sequentially performed with respect to each of the colors of the original image.

The toner images on the transfer sheet are thermally fixed thereon by using a pair of image fixing rollers composed of a heat-application roller and a pressure-application roller.

The heat-application roller is composed of a metal hollow core drum made of aluminum, stainless steel, iron or copper, and a thin elastomer layer, provided on the outer surface of the metal drum, of RTV (room temperature vulcanized) silicone rubber or HTV (high temperature vulcanized) silicone rubber with a thickness of approximately 0.5 to 10 mm. The surface of the elastomer layer, which is brought into close contact with toner images, is made smooth so that fixed images can exhibit high glossiness.

The pressure-application roller, which is brought into pressure contact with the heat-application roller to form a nip when toner images are fixed, is made of a metal core drum whose outer surface is covered with an relatively thick elastic layer such as of silicone rubber, fluorine rubber or fluorosilicone rubber, or a relatively thin layer made of a heat resistant resin having releasing properties such as ethylene tetrafluoride.

The heat-application roller, and, if necessary, the pressure-application roller are heated by any of the conventional methods. In order to improve the releasing ability of the rollers, it is preferable to coat a liquid having releasing properties, such as silicone oil, onto the surface of the rollers.

Other features of this invention will become apparent in the course of the following description of exemplary embodiments, which are given for illustration of the invention and are not intended to be limiting thereof.

EXAMPLE 1

Synthesis of Polyester Resin

A polyester resin was synthesized by condensing 7 moles of terephthalic acid, 2 moles of trimellitic acid and 9 moles of polyoxypropylene (2,2)-2,2-bis-(4-hydroxyphenyl)-propane by a conventional method.

Preparation of Developers

Yellow, magenta, cyan and black developers were respectively prepared in the following manner by using the above-synthesized polyester resin and a styrene-butylmethacrylate copolymer as binder resins.

1. A mixture having the following formulation was fused and thoroughly kneaded, and then cooled. The resulting mixture was crushed and classified, thereby obtaining a yellow developer having an average particle size of approximately 10 μm.

| <Formulation of Yellow Developer> | parts by weight |
|---|---|
| Polyester Resin | 80 |
| Styrene-butylmethacrylate copolymer "SBM-700" (Trademark, made by Sanyo Chemical Industries, Ltd.) | 20 |
| C.I. Pigment Yellow 17 | 5 |
| Chromium complex compound of 3,5-di-tert-butylsalicylic acid (charge controlling agent) | 1 |

The viscoelasticity ($\tan\delta^1$) of the above-prepared yellow developer was 3.1.

2. A mixture having the following formulation was fused and thoroughly kneaded, and then cooled. The resulting mixture was crushed and classified, thereby obtaining a magenta developer having an average particle size of approximately 10 μm.

| <Formulation of Magenta Developer> | parts by weight |
|---|---|
| Polyester Resin | 80 |
| SBM-700 (Trademark, made by Sanyo Chemical Industries, Ltd.) | 20 |
| C.I. Pigment Red 122 | 5 |
| Chromium complex compound of 3,5-di-tert-butylsalicylic acid (charge controlling agent) | 1 |

The viscoelasticity ($\tan\delta^1$) of the above-prepared magenta developer was 3.1.

3. A mixture having the following formulation was fused and thoroughly kneaded, and then cooled. The resulting mixture was crushed and classified, thereby obtaining a cyan developer having an average particle size of approximately 10 μm.

| <Formulation of Cyan Developer> | parts by weight |
|---|---|
| Polyester Resin | 80 |
| SBM-700 Trademark, made by Sanyo Chemical Industries, Ltd.) | 20 |
| C.I. Pigment Blue 15 | 5 |
| Chromium complex compound of 3,5-di-tert-butylsalicylic acid (charge controlling agent) | 1 |

The viscoelasticity ($\tan\delta^1$) of the above-prepared cyan developer was 3.1.

4. A mixture having the following formulation was fused and thoroughly kneaded, and then cooled. The resulting mixture was crushed and classified, thereby obtaining a black developer having an average particle size of approximately 10 μm.

| <Formulation of Black Developer> | parts by weight |
|---|---|
| Polyester Resin | 100 |
| Carbon Black | 5 |
| Chromium complex compound of 3,5-di-tert-butylsalicylic acid (charge controlling agent) | 1 |

The viscoelasticity ($\tan\delta^2$) of the above-prepared black developer was 3.4.

Preparation of Two-Component Type Developers

Three parts by weight of the above-prepared yellow developer and 97 parts by weight of a carrier of spherical ferrite were thoroughly mixed in a ball mill pot, thereby obtaining a two-component type yellow developer of the present invention.

Magenta, cyan and black two-component type developers of the present invention were also prepared by using the above-prepared magenta, cyan and black developers, respectively, in the same manner as described above.

Printing Test

Printing test was carried out by using a multi-color printer of a digital type in which were placed the above-prepared two component type developers of four colors.

In the printer used, a latent image corresponding to one of the separated colors is formed on a photoconductor in accordance with the corresponding digital color signal by using a laser beam, and then developed with the corresponding color developer. The developed toner image is transferred on a transfer sheet. The above procedure is repeated with respect to each of the other colors, and the obtained toner images of four colors are finally superimposed to obtain multi-color image.

It was found that the multi-color image obtained by conducting the 80% -UCR treatment exhibited even glossiness.

In accordance with the Test Method 3 of JIS-Z8741 (1983), which corresponds to ASTM D 523-80, the glossiness of the image was measured. As a result, the glossiness, Gs (60°), on a black solid area of the image was approximately 21%, and that on a secondary color area was approximately 20%. The black area and the secondary color area were found to exhibit almost the equal glossiness.

COMPARATIVE EXAMPLE

Preparation of Developers

Yellow, magenta, cyan and black developers were respectively prepared in the following manner by using the polyester resin synthesized in Example as a binder resin. 1. A mixture having the following formulation was fused and thoroughly kneaded, and then cooled. The resulting mixture was crushed and classified, thereby obtaining a yellow developer having an average particle size of approximately 10 μm.

| <Formulation of Yellow Developer> | parts by weight |
|---|---|
| Polyester Resin | 100 |
| C.I. Pigment Yellow 17 | 5 |
| Chromium complex compound of 3,5-di-tert-butylsalicylic acid (charge controlling agent) | 1 |

The viscoelasticity ($\tan\delta^1$) of the above-prepared yellow developer was 3.5.

2. A mixture having the following formulation was fused and thoroughly kneaded, and then cooled. The resulting mixture was crushed and classified, thereby obtaining a magenta developer having an average particle size of approximately 10 μm.

| <Formulation of Magenta Developer> | parts by weight |
|---|---|
| Polyester Resin | 100 |
| C.I. Pigment Red 122 | 5 |
| Chromium complex compound of 3.5-di-tert-butylsalicylic acid (charge controlling agent) | 1 |

The viscoelasticity ($\tan\delta^1$) of the above-prepared magenta developer was 3.5.

3. A mixture having the following formulation was fused and thoroughly kneaded, and then cooled. The resulting mixture was crushed and classified, thereby obtaining a cyan developer having an average particle size of approximately 10 μm.

| <Formulation of Cyan Developer> | parts by weight |
|---|---|
| Polyester Resin | 100 |
| C.I. Pigment Blue 15 | 5 |
| Chromium complex compound of 3.5-di-tert-butylsalicylic acid (charge controlling agent) | 1 |

The viscoelasticity ($\tan\delta^1$) of the above-prepared cyan developer was 3.5.

4. A mixture having the following formulation was fused and thoroughly kneaded, and then cooled. The resulting mixture was crushed and classified, thereby obtaining a black developer having an average particle size of approximately 10 μm.

| <Formulation of Black Developer> | parts by weight |
|---|---|
| Polyester Resin | 100 |
| Carbon Black | 5 |
| Chromium complex compound of 3.5-di-tert-butylsalicylic acid (charge controlling agent) | 1 |

The viscoelasticity ($\tan\delta^2$) of the above-prepared black developer was 3.4.

Preparation of Two-Component Type Developers

Three parts by weight of the above-prepared yellow developer and 97 parts b weight of a carrier of spherical ferrite were thoroughly mixed in a ball mill pot, thereby obtaining a comparative two-component type yellow developer.

Comparative magenta, cyan and black two-component type developers were also prepared by using the above-prepared magenta, cyan and black developers, respectively, in the same manner as described above.

Printing Test

Printing test was carried out by using the above-prepared four two-component type developers in the same manner as in Example. As a result, it was found that the glossiness of the printed images varied depending upon color, and the image quality was thus unsatisfactorily.

The glossiness of the printed images was measured by the same method as in Example. As a result, it was found that the glossiness, Gs (60°), of the black solid area was approximately 21%, and that of the secondary color solid area was approximately 32%.

What is claimed is:

1. A set of color developers for use in multi-color electrophotography, which comprises (a) a yellow developer, (b) a magenta developer, (c) a cyan developer, and (d) a black developer, in which the viscoelasticity ($\tan\delta^1$) of each of said yellow developer, said magenta developer and said cyan developer is smaller than the viscoelasticity ($\tan\delta^2$) of said black developer at a storage modulus ($G'(\omega)$) of $10^5$ dyn/cm$^2$.

2. The set of color developers for use in multi-color electrophotography as claimed in claim 1, wherein the viscoelasticity $\tan\delta^1$) of each of said yellow developer, said magenta developer and said cyan developer and the viscoelasticity ($\tan\delta^2$) of said black developer at a storage modulus ($G'(\omega)$) of $10^5$ dyn/cm$^2$ satisfy the relationship of:

$$2.8<\tan\delta^1<\tan\delta^2<3.8.$$

3. The set of color developers for use in multi-color electrophotography as claimed in claim 1, wherein each of developers comprises a binder resin, and a coloring agent.

4. The set of color developers for use in multi-color electrophotography as claimed in claim 3, wherein each of said developers further comprises a charge controlling agent.

5. The set of color developers for use in multi-color electrophotography as claimed in claim 3, wherein said binder resin is a polyester resin.

6. The set of color developers for use in multi-color electrophotography as claimed in claim 5, wherein said polyester resin is one prepared from an alcohol component including a bisphenol-type diol and a polyvalent carboxylic acid.

7. The set of color developers for use in multi-color electrophotography as claimed in claim 6, wherein said alcohol component further comprises an aliphatic polyol.

8. The set of color developers for use in multi-color electrophotography as claimed in claim 3, wherein said coloring agent for said black developer is selected from the group consisting of carbon black, aniline black, furnace black and lamp black.

9. The set of color developers for use in multi-color electrophotography as claimed in claim 3, wherein said coloring agent for said cyan developer is selected from the group consisting of Phthalocyanine Blue, Methylene Blue, Victoria Blue, Methyl Violet, Aniline Blue and Untramarine Blue.

10. The set of color developers for use in multi-color electrophotography as claimed in claim 3, wherein said coloring agent for said magenta developer is selected from the group consisting of Rhodamine 6G Lake, Watching Red, Rose Bengale, Rhodamine B and Alizarine Lake.

11. The set of color developers for use in multi-color electrophotography as claimed in claim 3, wherein said coloring agent for said yellow developer is selected from the group consisting of Chrome Yellow, Benzidine Yellow, Hansa Yellow, Naphthol Yellow, Molybdenum Orange, Quinoline Yellow and Tartrazine.

12. The set of color developers for use in multi-color electrophotography as claimed in claim 1, wherein each of said developers is a mono-component type developer.

13. The set of color developers for use in multi-color electrophotography as claimed in claim 1, wherein each of said developers can serve as a developer component of a two-component type developer comprising a developer component and a carrier component.

14. A multi-color electrophotographic image formation method of forming multi-color images on a transfer sheet, comprising the steps of:

(i) separating the colors of an original image into yellow, magenta, cyan, and black, (ii) converting said separated colors into the respective color signals, (iii) forming a latent electrostatic image corresponding to each of said separated colors on an electrophotographic photoconductor in accordance with said respective color signals, (iv) developing said latent electrostatic images to yellow, magenta, cyan and black images by a yellow developer, a magenta developer, a cyan developer, and a black developer, respectively, to form developed yellow, magenta, cyan and black images, the viscoelasticity ($\tan\delta^1$) of each of said yellow, magenta, and cyan developers being smaller than the viscoelasticity ($\tan\delta^2$) of said black developer at a storage modulus ($G'(\omega)$) of $10^5$ dyn/cm$^2$, and (v) transferring said developed yellow, magenta, cyan and black images to a transfer sheet.

15. The multi-color electrophotographic method as claimed in claim 14, wherein the viscoelasticity ($\tan\delta^1$) of each of said yellow, magenta and cyan developers and the viscoelasticity ($\tan\delta^2$) of said black developer at a storage modulus ($G'(\omega)$) of $10^5$ dyn/cm$^2$ satisfy the relationship of:

$$2.8 < \tan\delta^1 < \tan\delta^2 < 3.8.$$

16. The multi-color electrophotographic image formation method as claimed in claim 14, wherein said color signals are digital color signals which are obtained by converting said separated colors by an A/D conversion.

17. The multi-color electrophotographic image formation method as claimed in claim 14, wherein said steps (a) through (e) are sequentially performed with respect to each of the colors of said original image.

* * * * *